US005217161A

United States Patent [19]

Souza

[11] Patent Number: 5,217,161

[45] Date of Patent: Jun. 8, 1993

[54] SWIMMING POOL WATER SPRAY SCULPTURE

[76] Inventor: Carlos Souza, 530 Line Rd., Hazlet, N.J. 07730

[21] Appl. No.: 765,194

[22] Filed: Sep. 25, 1991

[51] Int. Cl.[5] ..... B05B 17/00

[52] U.S. Cl. ..... 239/20; 239/211; 239/587.1

[58] Field of Search ..... 239/17-20, 239/587, 211, 289, 587.1; 4/488, 492, 494, 496; D23/201, 215; D25/2

[56] References Cited

U.S. PATENT DOCUMENTS

| | | | |
|---|---|---|---|
| 402,553 | 5/1989 | Babcock | 239/17 X |
| 2,628,364 | 2/1953 | Wallace et al. | 4/494 |
| 3,318,528 | 5/1967 | Williams | 239/17 |
| 4,692,822 | 2/1987 | Tvengsberg | D25/2 |
| 5,105,482 | 4/1992 | Flynn et al. | 4/496 X |
| 5,115,974 | 5/1992 | Tobias et al. | 4/496 X |

FOREIGN PATENT DOCUMENTS

| | | | |
|---|---|---|---|
| 2744069 | 4/1979 | U.S.S.R. | 239/17 |

*Primary Examiner*—Andres Kashnikow
*Assistant Examiner*—Kevin Weldon
*Attorney, Agent, or Firm*—Charles I. Brodsky

[57] ABSTRACT

A swimming pool sculpture, according to the invention, is mounted on the edge of an above-the-ground pool. Recirculating water from the pool's filtration system is redirected back into the pool through the sculpture in the nature of a "spray" or "stream". In a preferred embodiment, the sculpture has a body portion secured to the ledge of the pool, and rotatable head portion through which the "spray" or "stream" is directed; with the head being interchangeable with others of like design, a swimming pool toy-accessory of different appearance and/or "spray pattern" may be provided, and one which requires no complex moving parts or piping systems, makes full use of the water available in the system, and maintains the whole area of the pool available for swimming. In an alternative construction of the invention, a valve may be added, to vary the pressure of the recirculating water introduced into the sculpture, and, thereby control the distance of the "spray" or "stream" into the pool.

7 Claims, 2 Drawing Sheets

SWIMMING POOL WATER SPRAY SCULPTURE

FIELD OF THE INVENTION

This invention relates to swimming pools, in general, and to a spray sculpture accessory for above-the-ground swimming pools, in particular.

BACKGROUND OF THE INVENTION

As is well known and understood, one of the greatest joys of city youths in the summer occurs when the temperature rises to a point where someone opens up a fire hydrant. There, the youths run in front of, and through the hydrant discharge, usually under the control of some brave soul who crouches behind the open hydrant with a flat board, broom stick, or other device, so as to deflect the hydrant stream either to the left, to the right, forward, up or down, so that others may run through it. It is not uncommon, but usually the situation, to see such activities depicted on almost any summer night's television news program, or in the pictures in a newspaper the next day.

As is also well known and understood, such joy and enthusiasm is repeated during the summer in the suburbs, where the youths run under the spray produced in a backyard by an oscillating sprinkler, by a reciprocating sprinkler, or by a travelling-type sprinkler. It is equally well known and understood that this joy and enthusiasm just does not seem to exist in an environment where a steady stream of water is produced—either from a swimming pool sidewall, from a continuously running fountain-type display, or from a sprinkler system which maintains a continuous, unchanging pattern. Whether the enjoyment is from the implicit understanding of running through the spray of a hydrant illegally turned-on, or whether it is from the feeling of running in one's bare feet on grass in the backyard, under the sprinkler, in all probability the excitement generated results from the fact that the deflected water flow, or falling spray pattern is intermittent, and an anxiety results in just waiting for the pattern to reach the area where the youth, the child or the infant stands, jumps, or sits, awaiting the cooling effects or the circulating water.

Unfortunately, and for some unknown reason, this joy, excitement and anxiety does not carry over into adulthood, and the above-the-ground swimming pools available on the market today.

OBJECTS OF THE INVENTION

It is an object of the present invention, therefore, to provide an apparatus to produce a "spray" or "stream" pattern for an above-the-ground swimming pool.

It is another object of the invention to provide such apparatus which is inexpensive to manufacture and simple to install, without any complex, moving parts.

It is a further object of the invention to provide apparatus of this type which requires no complex piping systems, and which makes full use of the whole area of the pool available for swimming.

It is a particular object of the invention to provide such swimming pool apparatus which can vary the "spray" or "stream" pattern being produced, and in an arrangement which is pleasing to the eye, and conducive for use by children of all ages.

SUMMARY OF THE INVENTION

As will become clear hereinafter, the apparatus of the present invention is in the form of a swimming pool sculpture comprising a head portion, and a body portion which is secured to a surrounding ledge of an above-the-ground pool. A source of circulating water from the pool's filtration system is redirected back into the pool by means of the body portion of the sculpture, either coupling with the sculpture through a side wall of the pool or over the top of the pool. A channel is then provided in the sculpture, between the body and head portions, so that the circulating water is allowed to reenter the pool through an orifice in the head portion. In accordance with a preferred embodiment of the invention, the sculpture is provided with a series of removable, interchangeable head portions, each of which can be alternatively screwed, or otherwise affixed, into place, with each having its own arrangement of orifices to vary the pattern of water produced for reentry into the pool. By further designing the sculpture so that the interchangeable head portions are directional in operation, the feeling of "anxiety" is re-created by one waiting for the spray pattern to reach him or her, and according to which different patterns of spray can be individually decided upon from time-to-time.

As will also be seen from the description that follows, an alternative embodiment of the invention anticipates the use of a plurality of additional apertured members—such as in the forms of "arms" or "legs"—, which affix to the body portion of the sculpture, and in a manner to also receive the flow of recirculating water, and so as to produce yet further patterns of spray into the pool for its occupants to run under. So as to vary the distance of the "spray" or "stream", the apparatus of the invention further utilizes a valve control to vary the pressure of the water introduced into the body portion of the sculpture, and designed in a manner such that any filtering water not utilized in operating the spray sculpture as described will, instead, flow directly into the swimming pool itself.

BRIEF DESCRIPTION OF THE DRAWINGS

These and other features of the present invention will be more fully understood from a consideration of the following description, taken in connection with the accompanying drawings, in which.

DETAILED DESCRIPTION OF THE DRAWINGS

Figure 1:
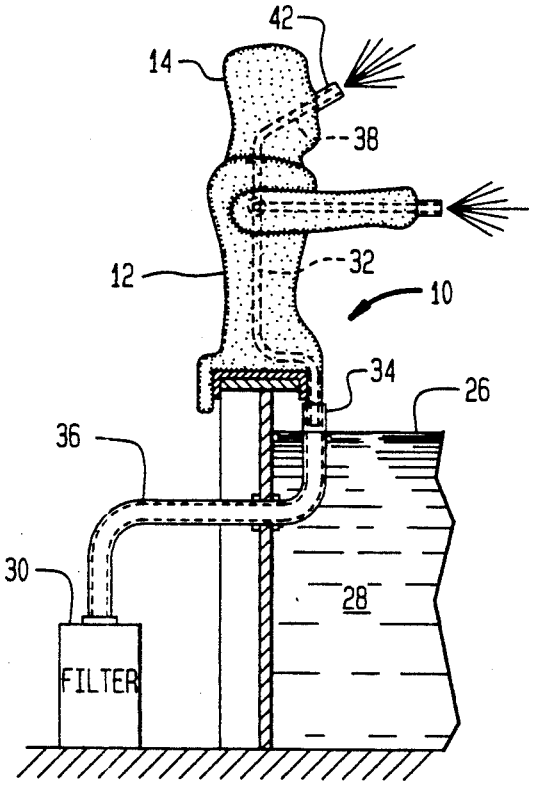
FIG. 1 illustrates a swimming pool water spray sculpture according to the invention in which recirculating water from the pool's filtration system is introduced through the sidewall of the above-the-ground swimming pool.
Figure 2:
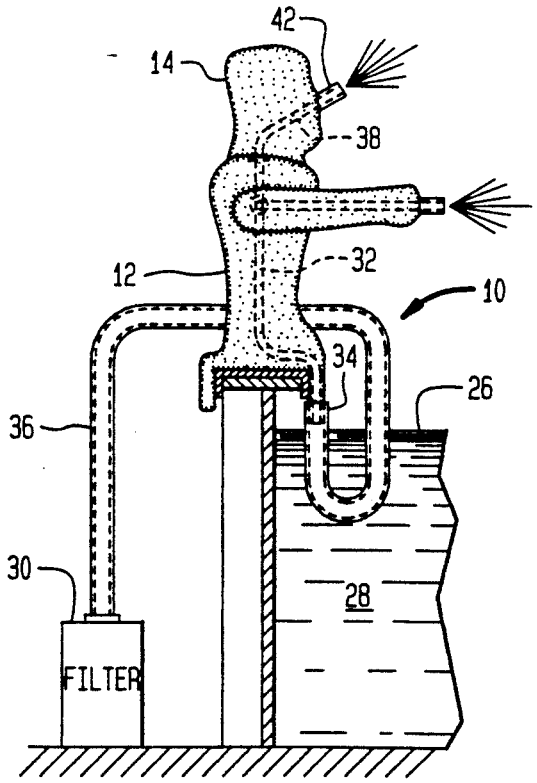
FIG. 2 is an illustration of the swimming pool water spray sculpture as it would appear when receiving recirculated water introduced by a coupling over a sidewall of the swimming pool.
Figure 3:
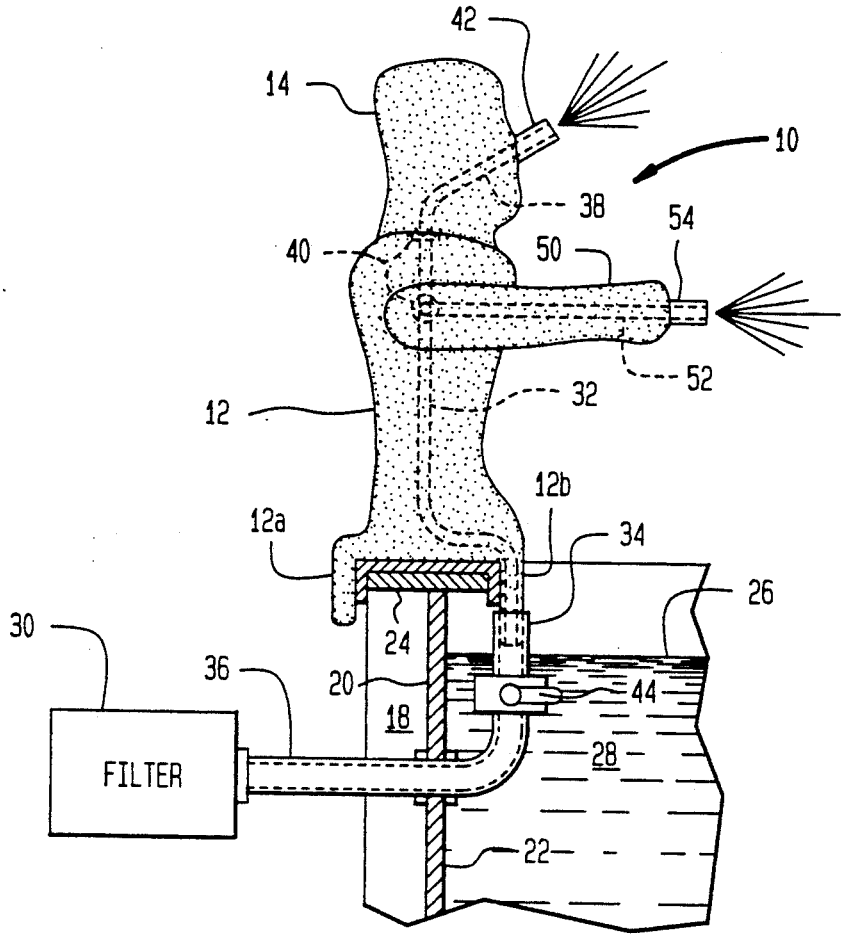
FIG. 3 is a side view of a swimming pool water spray sculpture helpful in an understanding of a preferred embodiment of the present invention, and in several of its alternative embodiments.

Referring to the drawings, the swimming pool water spray sculpture of the invention is shown by the reference numeral 10, as having a body portion 12 and a head portion 14. The lower extremes 12*a*, 12*b* of the body portion 12, furthermore, are constructed to provide a snug fit, so as to releasably secure the sculpture 10 to the ledge of an above-the-ground swimming pool, illustrated as having a post 18, a pool face 20, a liner 22 and a ledge 24 at the top of the pool, on which the sculpture 10 sits. Reference numeral 26 identifies the water level within the above-the-ground swimming pool 28, while the pool's filtration system is indicated as at 30, to apply the recirculating water back into the pool after filtering. As shown, the body portion 12 of the sculpture 10 is provided with a conduit, or channel, 32, along with a connector 34 to receive the filtered water, and by means of a hose 36. As illustrated in FIG. 1, the hose 36 introduces the filtered water to the conduit, or channel 32 by a coupling in any appropriate manner through the sidewall of the pool 28, the face 20 and the liner 22—as is also repeated in FIG. 3. In FIG. 2, on the other hand, the filtered water recirculates into the sculpture 10 by the hose 36 coupled over the sidewall of the pool, to join with the connector 34 in an alternate configuration.

Figure 4:
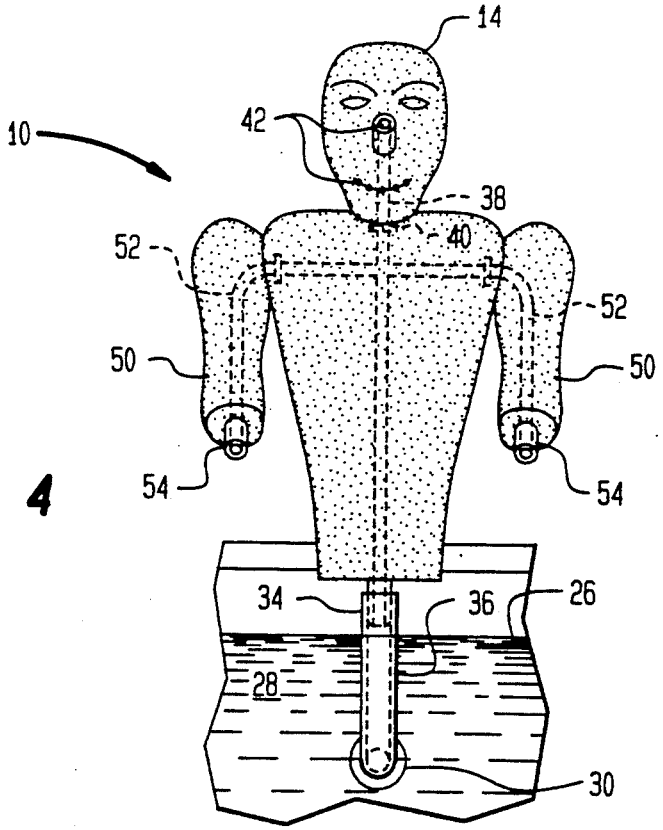
FIG. 4 is a front view of the swimming pool sculpture of FIG. 3.

As is also shown in the drawings, the head portion 14 of the sculpture 10 is provided with its own conduit, or channel 38, constructed of a length to fit together with the conduit, or channel, 32 of the body portion 12, where a rubber, or similar type, gasket 40 is provided, for purposes of sealing. In such manner, and in accordance with the invention, filtered water supplied under pressure from the system 30 enters the body portion 12 of the sculpture 10, to then travel into the head portion 14 where at least one orifice 42 is provided. As will be appreciated, the pressure with which the water enters from the filtration system 30 thus determines the distance of a "stream" of water exiting the orifice 42, or the distance that a "spray" might shoot if a plurality of orifices were instead incorporated in the head portion 14, as shown by the added orifice notations 42 in FIG. 4. To provide this degree of control, a valve 44 may be added to the apparatus, within the pool 28, between the liner 22 and the connector 34, operable to return the available water to the pool when the sculpture is operating with less than full pressure, or when the sculpture is turned off.

In accordance with a preferred embodiment of the invention, the head portion 14 is not only designed, as indicated above, to be removable, but is of a type as constructed in the prior art to be rotatable by hand, as well. Thus, depending upon the pressure of the recirculating water flow into the conduit, or channel 32 of the body portion 12, the "spray" or "stream" of the reintroduced water would not only be farther, or shorter in distance, but the direction of the rotatable head can be varied in providing its stream pattern wherever desired about the pool. In this manner, the head portion 14 can be readily removed, and interchanged with another of like operating design, but yet producing a different physical appearance and/or different spray patterning. A degree of variety thus results, in accordance with the preferences with the person setting up the sculpture at any given instance of time, and pointing the stream this way or that way.

In operation then, it will be seen that depending upon the configuration of the head portion 14 of the sculpture 12, a flow of water then "sprays" or "streams" into the pool under control of the filtration system (with or without the pressure varying valve), and in a direction to satisfy the desires of those in the pool, enjoying the stream of the filtered water back into the pool and its circulating systems, or just swimming in the pool area where the stream does not reach.

In yet a further embodiment of the invention, it might be desired to vary the design of the sculpture—as by adding arms, legs, or other body members, each with their own apertures to define additional "spray" or "stream" patterning into the pool. In such instance—as illustrated by the arms 50 in FIGS. 3 and 4—, it will be appreciated that such members, also, are provided with their own conduit, or channel systems 52, and with appropriate valvings, gaskets, and connectors to couple with the conduit, or channel, 32 of the body portion 12 in directing the introduced recirculating water to their various extremities. Provided with their own arrangements of orifices, or apertures 54, these alternate extensions can likewise be arranged to be angled upwardly, or downwardly, from the positions shown in FIGS. 3 and 4, to again predetermine a pattern of water flow into the pool from left-to-right, and/or up-to-down, depending upon the preferences of the pool use that day.

As will be seen from the discussion above, this "spray" or "stream" patterning is available without the need for any complex moving parts in the apparatus, without the need for any complex piping, and is one which does not interfere with the area available in the pool for its occupants to swim in. If desired, the sculpture can easily be removed from the pool edge by loosening the snug fit at 12*a*, 12*b*, and—when installed—does not require any additional supply of water for operation, but merely that which is going to be recirculated back into the pool by the filtration system. If desired, the individual head and body portions of the sculpture can be manufactured in a simple mold, of plastic material or, if desired for even greater simplicity, can be constructed in a single mold, joining the head and body portions together, where the ultimate sculpture would then be one having a non-removable, non-rotatable head. Where such features are important, the mold would be a two piece mold, one for each portion, with or without the various interconnects required to fit the two together for use.

While there have been described what are considered to be preferred embodiments of the present invention, it will be readily appreciated by those skilled in the art that modifications can be made without departing from the scope of the teachings herein, of providing a water spray sculpture for the edge of an above-the-ground swimming pool preferably with, an interchangeable, head portion, rotatable by hand—but one in which the body and head portions could be molded together, where a non-rotatable, non-interchangeable construction then results. It will be appreciated that either construction is in accordance with the teachings of the invention, and for such reason, resort should be had to the claims appended hereto for a true understanding of the scope of the improvement.

I claim:

1. Apparatus for an above-the-ground swimming pool of the type incorporating a surrounding ledge, comprising:

a sculpture secured to said ledge having a body portion and a head portion;

means supplying a source of circulating water to said body portion for introduction into said pool;

a channel in said sculpture between said body and head portions for coupling said water source to said head portion; and at least one orifice in said head portion for directing said circulating water into said pool;

wherein said sculpture is composed of a body portion secured to said pool ledge and a removable head portion, and wherein said channel interconnects said body and head portions when fitted together wherein said removable head portion is rotatable by hand.

2. The apparatus of claim 1 wherein each of said body and head portions include internal conduits arranged to couple together to form said channel when fitted.

3. The apparatus of claim 1 wherein said means supplies said circulating water by coupling through a wall of the above-the-ground swimming pool to said body portion.

4. The apparatus of claim 1 wherein said means supplies said circulating water by coupling over a wall of the above-the-ground swimming pool to said body portion.

5. The apparatus of claim 1 wherein said head portion includes a plurality of orifices for directing said water into said pool in a predetermined pattern.

6. The apparatus of claim 1 wherein said sculpture also includes a plurality of apertured members coupled with said body portion, each with its own individual channel interconnecting with said channel between said body portion and said head portion, for directing said circulating water into said pool through their respective apertures.

7. The apparatus of claim 1, also including valve means for varying the pressure of circulating water applied to said body portion by said means.

* * * * *